United States Patent [19]

Withey

[11] 4,428,506

[45] Jan. 31, 1984

[54] PERSONAL PROTECTION DEVICE

[76] Inventor: Edward L. Withey, 950 Andante Rd., Santa Barbara, Calif. 93105

[21] Appl. No.: 325,984

[22] Filed: Nov. 30, 1981

[51] Int. Cl.[3] ..... B67B 7/24

[52] U.S. Cl. ..... 222/80; 222/83; 222/175; 604/306

[58] Field of Search ..... 222/83, 83.5, 87, 175, 222/325, 78, 82, 80, 81; 239/289, 309; 63/DIG. 2, 1 R; 428/905; 604/200, 244, 306

[56] References Cited

U.S. PATENT DOCUMENTS

| | | | |
|---|---|---|---|
| 2,745,751 | 5/1956 | Pichardo | 222/83 X |
| 3,333,736 | 8/1967 | Hopkins | 222/83 |
| 3,974,942 | 8/1976 | Gray et al. | 222/83.5 |
| 4,135,645 | 1/1979 | Kimmell | 222/83 |
| 4,241,850 | 12/1980 | Speer | 222/162 X |

*Primary Examiner*—Robert B. Reeves
*Assistant Examiner*—Russell D. Stormer
*Attorney, Agent, or Firm*—Harry W. Brelsford

[57] ABSTRACT

Persons can be protected against rape or other bodily assault by wearing this device which includes a frangible capsule of repellant material such as ammonia or fluids of noxious smell. The capsule of material is quickly opened by slashing it with a manually operable knife which for example, may be operated by a pull cord. Passages leading from the container area for the capsule lead to the body of the wearer, so that the body of the wearer will be wetted or otherwise covered with the foul smelling or repellant material. The pull cord may be attached to the clothing of the wearer so that removal of the clothing by an attacker will automatically cut the capsule to release the fluid.

2 Claims, 4 Drawing Figures

PERSONAL PROTECTION DEVICE

TECHNICAL FIELD

This invention relates to personal protective devices to repel an attacker and has particular reference to a device for releasing a repellant fluid upon the body of the user of the device.

BACKGROUND OF PRIOR ART

It is well known that the release of a strong noxious or evil smelling fluid upon the body of a woman will stop an attacker from committing rape or other body contact assault. The release of liquid or gaseous ammonia has this effect as well as more noxious smells such as skunk scent or various mercaptans.

In the prior art various self protection devices are known, most of which have a container or capsule holding a liquid or gas under pressure. The prior art container or capsule is broken by piercing the capsule or container with a pin or other sharp point, releasing the fluid. Most of these prior art devices also are constructed to direct a stream of liquid or gas at an attacker.

These prior art devices are poorly constructed, however, to quickly release a fluid not under pressure.

BRIEF SUMMARY OF THE INVENTION

I have devised a capsule and a mechanism for rupturing the capsule that permits using fluid not under pressure. My rupturing mechanism is a knife that slashes a wide opening in the capsule compared to the small opening made by a sharp point piercing a capsule. The wide slash results in instantaneous release of the noxious liquid or gas.

My mechanism is preferably disposed in a body member that fits closely and inconspicuously against the body of the user.

Alternatively, it may be incorporated in a locket or belt buckle, etc. These conspicuous structures may have the appearance of jewelry for a locket or maybe be incorporated in a belt buckle design.

I provide passages in the body member for quick dispersal of the fluid to the body of the user. I further provide for the automatic operation of the device if the user is unable to manually activate the knife, and this may be accomplished by connecting a pull cord to an article of clothing of the user that might be removed by an attacker.

My structure is primarily a passive defence device and is not employed as a threat against an attacker. The attacker will not know of its presence until it is activated, and even then would have difficulty in locating the source of the noxious fluid.

BRIEF DESCRIPTION OF THE DRAWINGS

Various objects, advantages and features of the invention will be apparent in the following description and claims considered together with the drawings forming an integral part of the specification, and in which:

DETAILED DESCRIPTION OF INVENTION

Figure 1:
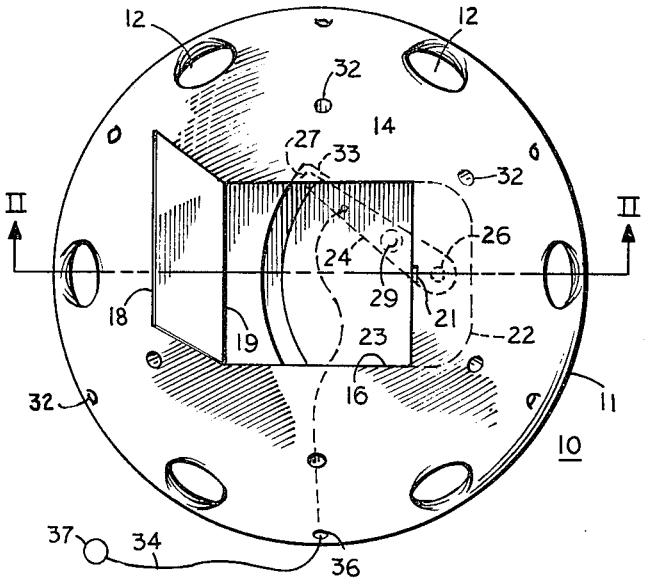
FIG. 1 is a plan view of a locket type of device incorporating the invention, with capsule removed.
Figure 2:
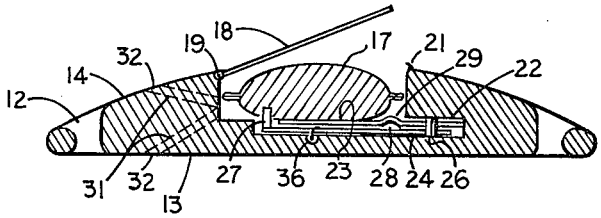
FIG. 2 is a sectional view along the line II of FIG. 1.
Figure 3:
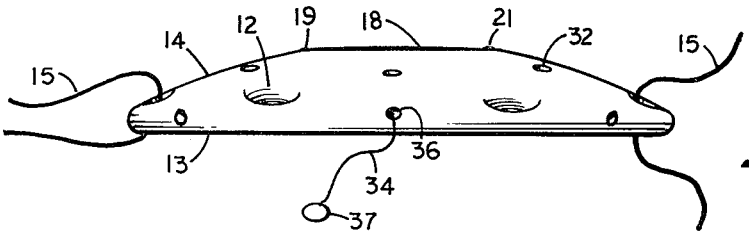
FIG. 3 is a side elevation view of the device of FIGS. 1 and 2.

Referring to FIGS. 1, 2 and 3 the protection device 10 includes a body member 11 having a series of holes 12 spaced around the periphery for the reception of cords or straps to hold the body member 11 to the body or the person of the user. Illustrated in FIG. 3 are cords 15 passing through two of these holes 12. The body member 11 has an inner surface 13 adapted to bear against the body of the user and has an outer surface 14. Formed within the outer surface 14 is a cavity 16 in which is disposed a capsule 17 containing a repellant fluid such as liquid or gaseous ammonia, skunk scent or various of the mercaptants that have an offensive odor. The capsule 17 may be made of any suitable plastic or may be made of foil or any other material that is frangible or easily cut by a knife blade. The opening 16 is closed by a cover 18 hinged at 19 and held in a closed position by a catch 21. The size of the capsule 17 is selected so that the cover 18 presses against it when the cover is held by the catch 21 preventing the capsule 17 from moving about the recess 16 so that it will be firmly held when the time arrives for slashing the capsule with a knife.

Disposed in the bottom of the recess 16 and disposed partly within a right angle extension 22 of this recess is a floor sheet or board 23 upon which the capsule 17 rests. Hinged to this floor board 23 is a knife arm 24 hinged at 26. At the outer end of the knife arm 24 is a vertical knife blade 27 and this is the blade that causes the slashing of the capsule 17 to release the contents of the capsule. A suitable detent holds the knife arm 24 in the position illustrated in FIG. 1 and this may take any form such as a projection 28 on the knife arm 24 engaging a dimple 29 on the floor board 23. The floor board 23 and the knife arm 24 are preferably made of sheet material such as thin metal sheet or stiff plastic sheet.

Communicating with the bottom of the recess 16 are a plurality of passages 31 provided particularly in accordance with the invention and terminating at the outer surface 14 of the body member 11 as holes 32. With reference to FIGS. 1 and 3 it will be noted that there are a number of these holes 32 disposed about the periphery of the body member 11. Shown particularly in FIG. 1 is an enlargment on the cavity 16 which enlargement is designated as 33 where the knife blade 27 is normally positioned so as to be out of contact with the capsule 17.

Provided particularly in accordance with the invention is a cord connected to the knife arm 24 and this cord is designated by the numeral 34 and this cord passes through a passage 36 in the bottom of the recess 16.

This cord 34 may be connected to the clothing of the user which clothing is designated by the object 37 in FIGS. 1 and 3. If therefore, a would-be rapist attempts to remove the clothing of a woman and the cord 34 is attached to the clothing, the clothing removal will cause a pull on the cord 34 which will pull the knife arm downwardly with respect to FIG. 1 causing a long slash in the capsule 17, releasing its contents through the passages 31 and the passage outlets 32 to wet the body of the wearer of the device with a noxious liquid or gas which will deter the would-be rapist.

OPERATION

To operate the device, the capsule 17 is inserted in the cavity 16 of FIG. 1 whereupon the hinged lid 18 is closed over the capsule 17 and retained in the closed position by the catch 21. The lid 18 compresses the capsule 17 against the floor board 23 so that it cannot move. When it is desired to release the contents of the capsule 17 the user pulls on the cord 34 which causes the knife arm 24 to move downwardly as viewed in FIG. 1 whereupon the vertical knife blade 27 slashes a long cut through the capsule 17 quickly releasing all of its contents. The contents flow into the passages 31 and out the outlets 32 to wet the body of user with the foul smelling liquid or gas in the capsule 17. This foul smelling material deters the attacker and causes him to stop his attack and leave his would-be victim. The cord 34 may also be attached an article of clothing 37 so that if the would-be victim is unable physically to pull on the cord 34, the removal of an article of clothing from the would-be victim automatically pulls on the cord 34 to cause the knife arm to overcome the detent 28–29 and slash the bottom of the capsule 17.

MODIFICATION

Figure 4:
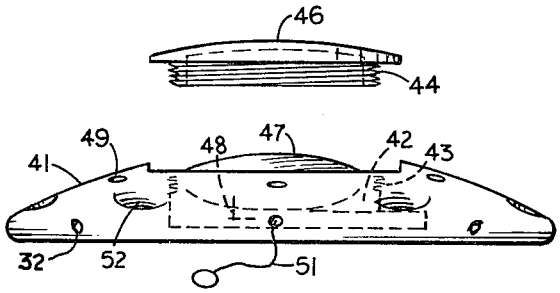
FIG. 4 is an elevation view of a modified form of the invention showing a screw-on cap rather than a hinged cap.

Illustrated in FIG. is a modified form wherein a body member 41 has a circular cavity 42 that is internally threaded at 43 to receive threads 44 on a round cap 46. A capsule 47 may be disposed in the cavity 42 and the round cap 46 may press against the capsule 47 to hold it securely in place so that it can be slashed by a knife blade 48 mounted on a knife arm similar to that illustrated in FIGS. 1 through 3. The body member 41 may have the usual repellant passages 49, a pull cord 51 and holes 52 to receive cords or other means of holding the device against the body of the user. In both the modification of FIG. 4 and the device of FIGS. 1, through 3, the entire device may be in the form of a decorative locket if it is so desired, or it may be inconspicuously strapped to any portion of the body of the user. Additionally the structure of either FIG. 4 or FIGS. 1 through 3 may be incorporated in a belt buckle and actuated in the same fashion by a pull cord or any other manual device.

STATEMENT OF INDUSTRIAL APPLICATION

The device of the patent application is useful in deterring attacks on the person of the user of the device. When an attack is threatened the user merely pulls on the cord 34 of FIGS. 1 through 3 slashing the capsule 17 releasing a foul smelling or obnoxious odor which causes the attacker to stop his attack. The device is an efficient protective device for women and for other persons subjected to personal assaults.

I have described my invention with respect to the presently preferred embodiments thereof as required by the patent statutes. The embodiment described and illustrated, however, is merely an example of one form or two forms of the invention and is not limiting. Included within the scope of the following claims are all modifications and variations that fall within the true spirit and scope of the invention.

I claim:

1. A personal protection device adapted to be carried inconspicuously on the body comprising:

(a) a body member of generally flat shape having inner and outer surfaces and having a cavity formed in the outer surface and having passages leading from said cavity to at least one surface;

(b) a frangible and flexible capsule disposed in the cavity and containing a repellant fluid;

(c) a knife pivoted to the body member and having a rest position away from said cavity, and having an arc of movement across said cavity;

(d) pull cord means connected to the knife for manually moving said knife through its arc of movement;

(e) and a cap connected to said body member and covering said cavity, said cap and capsule having a size to hold the capsule stationary in the cavity so that it can be slashed when the knife is manually operated.

2. A personal protection device as set forth in claim 1 wherein detent means are provided for releasably holding the knife out of contact with the capsule.

* * * * *